US010871105B1

(12) United States Patent
Moore

(10) Patent No.: US 10,871,105 B1
(45) Date of Patent: Dec. 22, 2020

(54) ROTATING INTERNAL COMBUSTION ENGINE

(71) Applicant: Maynard Moore, Austintown, OH (US)

(72) Inventor: Maynard Moore, Austintown, OH (US)

( * ) Notice: Subject to any disclaimer, the term of this patent is extended or adjusted under 35 U.S.C. 154(b) by 0 days.

(21) Appl. No.: 16/424,606

(22) Filed: May 29, 2019

(51) Int. Cl.

| | |
|---|---|
| ***F02B 53/10*** | (2006.01) |
| ***F02B 53/12*** | (2006.01) |
| ***F02B 55/00*** | (2006.01) |
| ***F02B 55/02*** | (2006.01) |
| ***F02B 55/08*** | (2006.01) |
| ***F02B 55/14*** | (2006.01) |

(52) U.S. Cl.
CPC ..... *F02B 55/14* (2013.01); *F02B 53/10* (2013.01); *F02B 53/12* (2013.01); *F02B 55/00* (2013.01); *F02B 55/02* (2013.01); *F02B 55/08* (2013.01)

(58) Field of Classification Search
CPC ..... F02B 53/10; F02B 53/12; F02B 55/00; F02B 55/02; F02B 55/08; F02B 55/14; F02B 2075/125
See application file for complete search history.

(56) References Cited

U.S. PATENT DOCUMENTS

| | | | | |
|---|---|---|---|---|
| 800,684 | A * | 10/1905 | Schneider | F02C 9/42 60/39.15 |
| 4,024,842 | A * | 5/1977 | Dumaine | F01C 21/08 123/218 |
| 4,209,983 | A * | 7/1980 | Sokol | F02G 1/04 60/325 |
| 2005/0188675 | A1* | 9/2005 | Chou | F02C 5/04 60/39.44 |
| 2006/0207546 | A1* | 9/2006 | Bechtel | F02B 53/02 123/241 |
| 2008/0141974 | A1* | 6/2008 | Bechtel | F02B 53/02 123/243 |

* cited by examiner

*Primary Examiner* — Audrey K Bradley
(74) *Attorney, Agent, or Firm* — Harness, Dickey & Pierce, P.L.C.

(57) ABSTRACT

An engine design of a rotating pistonless, non-reciprocating internal combustion engine having an engine block having a drive chamber formed in an interior combustion surface having a drive surface and a sloped transitionary portion, and a rotor rotatably supported within the engine block. The rotor having a radially extending disc portion having a plurality of rotor combustion chambers. Each of the rotor combustion chambers has a pyramidal-shaped volume having a driven surface and a sloped transitionary portion, wherein combustion pressure in the rotor combustion chamber and drive chamber is exerted upon the drive surface of the drive chamber and the driven surface of the rotor combustion chamber resulting in driven rotation of the rotor.

59 Claims, 8 Drawing Sheets

ROTATING INTERNAL COMBUSTION ENGINE

FIELD

The present disclosure relates to rotary internal combustion engines and, more particularly, to a rotating internal combustion engine having an improved efficiency combustion chamber.

BACKGROUND AND SUMMARY

This section provides background information related to the present disclosure which is not necessarily prior art. This section provides a general summary of the disclosure, and is not a comprehensive disclosure of its full scope or all of its features.

According to the principles of the present teachings, a simpler, more-efficient, power-generating internal combustion engine of a revolutionary new design is provided that permits very high effective torque and horsepower for its size, weight, and fuel consumption. The present internal combustion engine further provides these improvements while emitting cleaner emissions for the volume of fuel consumed. Capable of performing with a variety of fuels and in a variety of physical sizes, the present teachings are applicable to a wide variety of industries, including, but not limited to, automobile/light truck, medium duty truck or RV, heavy truck, motorcycle, marine, aviation, powersport vehicles, industrial power applications, gas-oil mining, agriculture, railroad, military, and the like.

In some embodiments, the present teachings of the internal combustion engine employ an external, yet attached, compressor to supply compressed oxidant and high pressure fuel injection supplying a preferred fuel to the engine and the engine, by design, has longer and higher effective torque moments with a much longer effective duration, thereby promoting a more complete fuel burn, less exhausted heat, lower fuel consumption, and cleaner emissions.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 2:
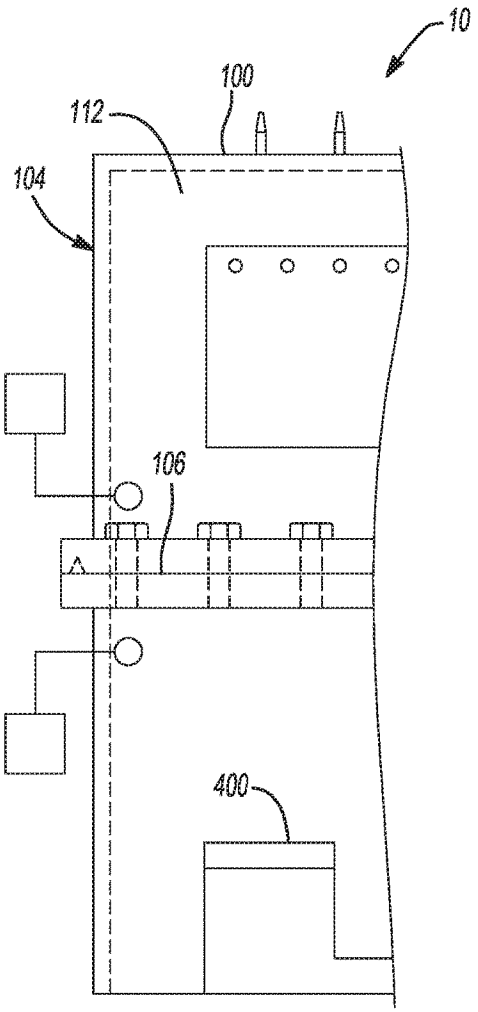
FIG. 2 is a partial side view illustrating the rotating internal combustion engine according to the principles of the present teachings.
Figure 1:
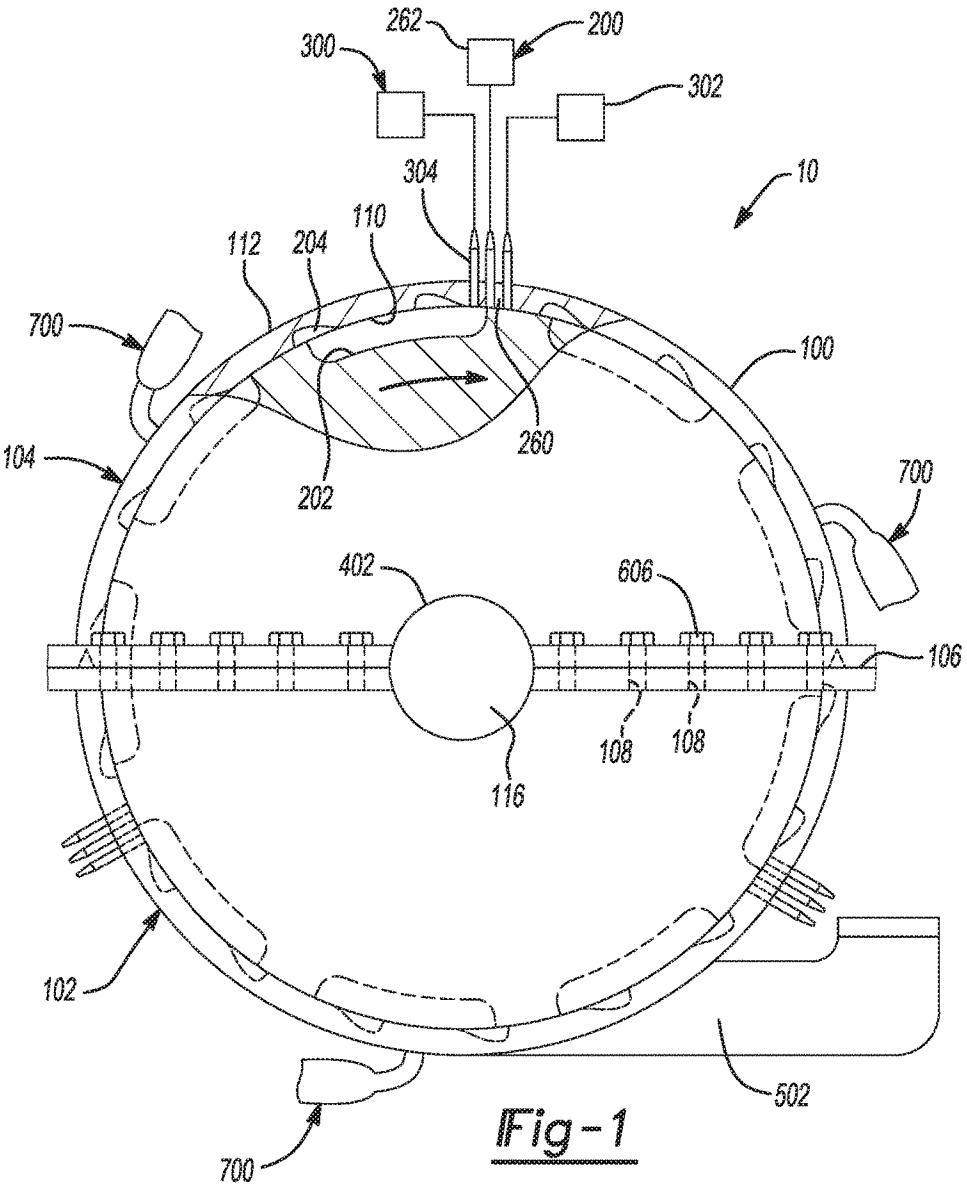
FIG. 1 is an end view illustrating a rotating internal combustion engine according to the principles of the present teachings.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Generally, the present disclosure provides an engine design of a rotating pistonless, non-reciprocating internal combustion engine using spark, laser, flame or compression ignition. An attached air compressor, such as a twin screw design, provides pressurized air to air injectors, supplying rotor combustion chambers for combustion and purging of exhaust gases after pressures have subsided. The rotor combustion chambers are designed to allow for an efficient usage of combustion pressure via a (repeatable) stroke length and are designed to accommodate multiple chambers around the circumference surfaces of a rotor allowing each chamber to produce multiple and/or simultaneous firing impulses per revolution. The engine can comprise any number of rotor discs or chambers, and be of any acceptable diameter to maximize torque output.

In accordance with the teachings of the present disclosure and with reference to FIGS. 1-24, a rotating internal combustion engine 10 is provided having an improved efficiency combustion chamber. In some embodiments, internal combustion engine 10 can comprise an engine block 100, an air induction system 200, a fuel system 300, and oiling system 400, a cooling system 500, a plurality of fasteners 600, and an exhaust system 700. However, it should be understood that variations could exist in connection with rotating internal combustion engine 10, such as variation in size, shape, componentry, and operation, without departing from the principles of the present invention. Therefore, the following disclosure is provided for purpose of disclosing one or more preferred embodiments of the present invention.

With reference to FIGS. 1-6, in some embodiments, engine block 100 can comprise a lower half block 102 and an upper half block 104. Lower half block 102 can be joined or otherwise coupled to upper half block 104 along a mating joint 106. In some embodiments, mating joint 106 includes an O-ring seal there within to maintain a fluid seal within a volume defined by lower half block 102 and upper half block 104. In some embodiments, lower half block 102 and upper half block 104 can together define engine block 100. Engine block 100 can comprise any number of shapes or designs, such as, but not limited to, a cylindrical case having opposing ends. Lower half block 102 can be positioned relative to upper half block 104 along mating joint 106 via one or more dowel pins 602 that are complementarily sized and located on at least one of lower half block 102 and upper half block 104 to be received within a corresponding dowel pin hole or slot 604 formed on the other of lower half block 102 and upper half block 104. In this manner, dowel pins 602 and dowel holes 604 together serve to positively position and locate lower half block 102 relative to upper half block 104. Still further, in some embodiments, lower half block 102 can be coupled to upper half block 104 along mating joint 106 via one or more block attachment bolts 606 that are complementarily sized and located to extend through corresponding block bolt holes 108. It should be noted that block bolt holes 108 can be through holes and/or threaded holes to threadedly engage block attachment bolts 606 to retain lower half block 102 to upper half block 104. However, in some embodiments, other known fastening systems or configurations can be used, such as but not limited to bolt and separate fastener configurations, clamps, or other systems.

With continued reference to FIGS. 1-6, in some embodiments, lower half block 102 and upper half block 104 can each comprise an outer coolant chamber 502. Outer coolant chamber 502 can comprise an internal channel system within one or both of lower half block 102 and upper half block 104 that is configured to transfer a cooling fluid, such as but not limited to coolant, antifreeze, glycol, water, and the like, to remove thermal energy from internal combustion engine 10 and systems thereof. Outer coolant chamber 502 can be fluidly coupled to a coolant hose 504 via one or more coolant ports 506 to transfer the cooling fluid from a coolant source 508 to outer coolant chamber 502. However, it should be appreciated that outer coolant chamber 502 may not be required in all embodiments, such as those that are cooled by air or other means.

In some embodiments, upper half block 104 and lower half block 102 can together define slots or apertures sized to receive a front oil seal 402 and a rear oil seal 404. Front oil seal 402 and rear oil seal 404 can be captured and retained by upper half block 104 and lower half block 102.

Figure 3:
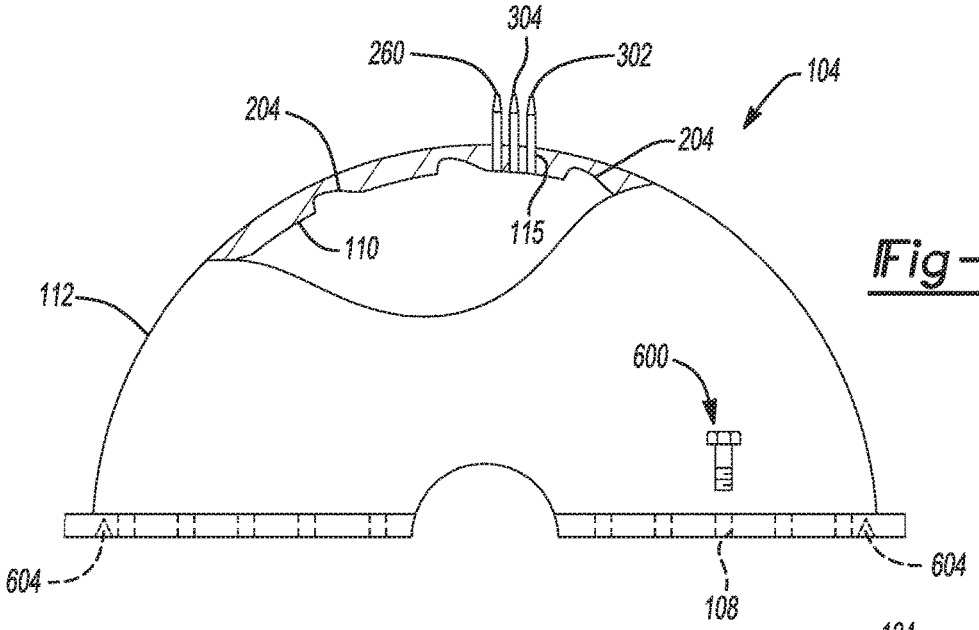
FIG. 3 is an end view illustrating, with portions in cross section, of an upper half block of the rotating internal combustion engine according to the principles of the present teachings.
Figure 4:
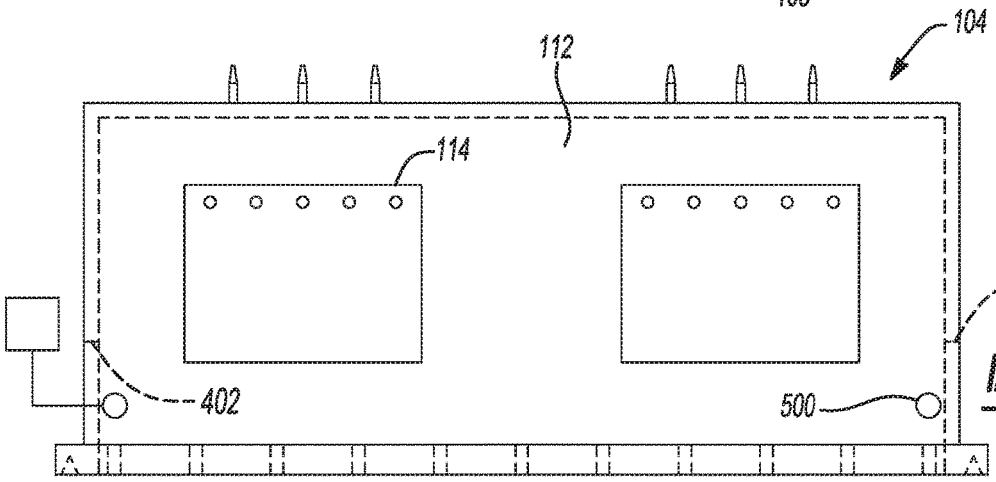
FIG. 4 is a side view illustrating, with portions in cross section, of the upper half block of the rotating internal combustion engine according to the principles of the present teachings.
Figure 5:
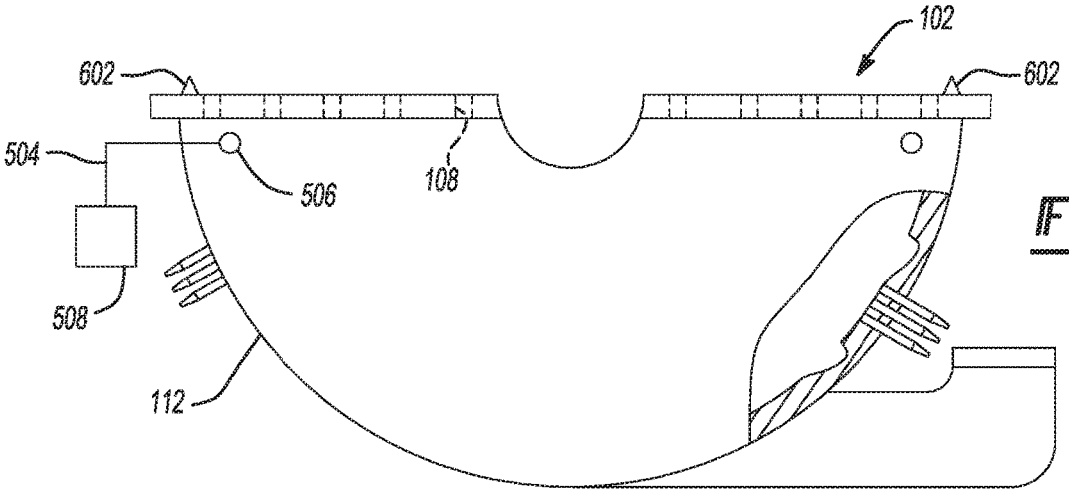
FIG. 5 is an end view illustrating, with portions in cross section, of an lower half block of the rotating internal combustion engine according to the principles of the present teachings.
Figure 6:
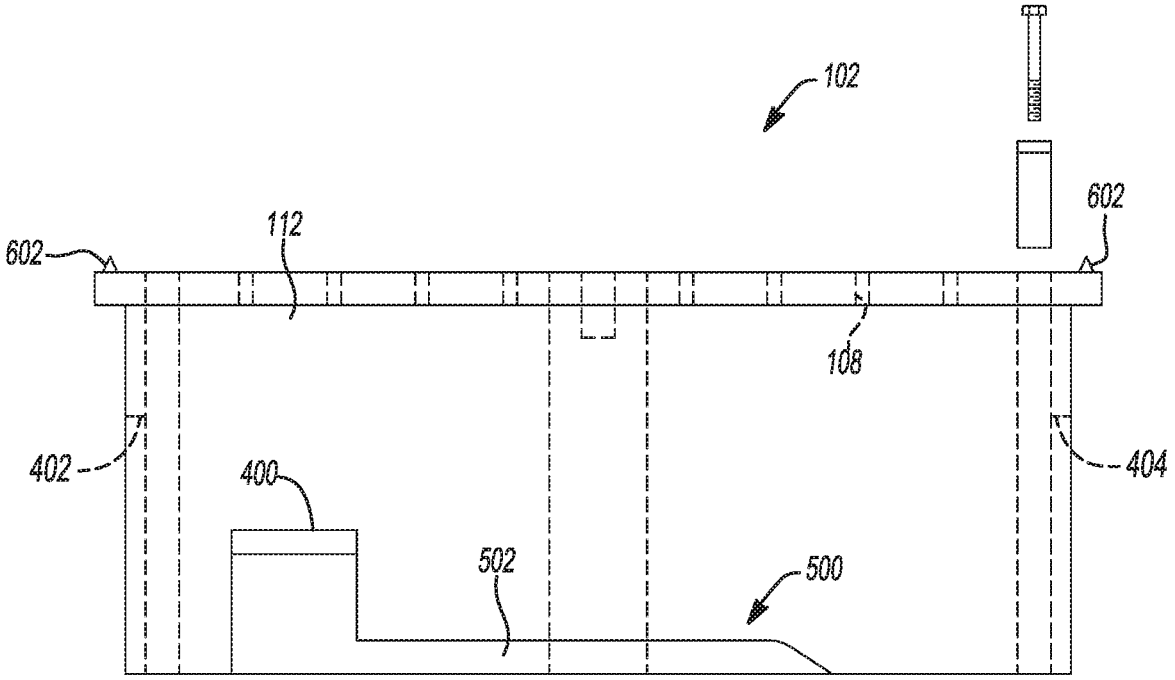
FIG. 6 is a side view illustrating, with portions in cross section, of the lower half block of the rotating internal combustion engine according to the principles of the present teachings.
Figure 7A:
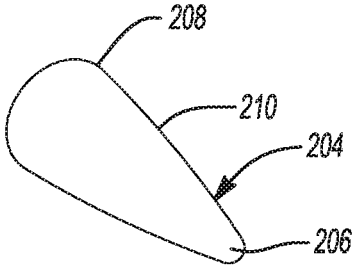
FIG. 7A is a top view illustrating a drive chamber according to the principles of the present teachings.
Figure 7B:
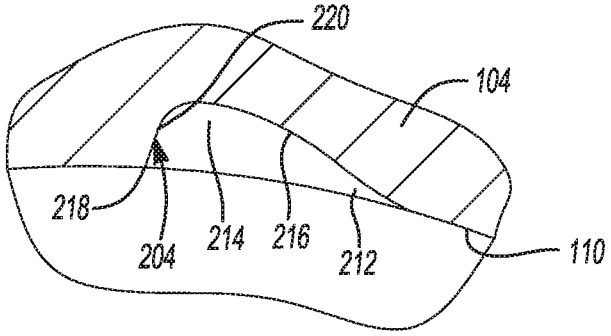
FIG. 7B is a cross-sectional view illustrating the drive chamber according to the principles of the present teachings.

In some embodiments, as illustrated in FIGS. 1-4, lower half block 102 and/or upper half block 104 can comprise an interior combustion surface 110 generally offset from an exterior surface 112. In some embodiments, interior combustion surface 110 comprises a drive chamber 204 that is positioned relative to a rotor combustion chamber 202, to be described in detail herein. As will be discussed herein, rotating internal combustion engine 10 can comprise one or more rotor combustion chambers 202 being configured and shaped to reduce the occurrence of hot spots while providing an efficient, aerodynamic driving surface upon which chamber pressure can use as an opposing pressure drive force point. In some embodiments, as illustrated in FIGS. 3, 7A, and 7B, drive chamber 204 can comprise a general pyramidal shape having a triangular shape when viewed from an exterior perspective (see FIG. 7A). The generally triangular shape can have a narrow portion 206, a wide portion 208, and a transitionary portion 210 extending between narrow portion 206 and wide portion 208. In some embodiments, narrow portion 206 can terminate at a radiused tip. Likewise, in some embodiments, wide portion 208 can comprise a pair of radiused corners. Still further, in some embodiments, transitionary portion 210 can be generally, consistently tapered or, in some embodiments, define a transition wherein the sides thereof are convex or concave, or define some other desirable shape. With reference to FIG. 7B, in some embodiments, drive chamber 204 can define a slope configuration when viewed in cross-section that extends from a shallow portion 212 to a deeper portion 214 along a sloped portion 216. In some embodiments, shallow portion 212 can begin at a tangent of interior combustion surface 110 to form a smooth surface without a transitionary edge. However, in some embodiments, shallow portion 212 can form an initial concave shape that produces a shallow portion edge. Likewise, deeper portion 214 can terminate at a termination edge 218 formed at interior combustion surface 110 to define a drive surface 220. Drive surface 220 is configured to provide an aerodynamic driving surface upon which chamber pressure can be used as an opposing-pressure, drive-force point. In some embodiments, termination edge 218 can define an angle with interior combustion surface 110 in the range of 60-90 degrees, or, more preferably, in the range of 70-90 degrees. It should be understood, however, that termination edge 218 could be radiused or otherwise formed to eliminate a defined edge, if desired. In some embodiments, for example, wide portion 208 can be about 0.5", an axial length between narrow portion 206 and wide portion 208 can be about 0.75", a depth of deeper portion 214 can be about 0.5", and drive chamber 204 can have a volume of approximately 0.03 cubic inches.

In some embodiments, upper half block 104 can comprise one or more inspection plates or panels 114. Inspection panel 114 can be fastened or otherwise coupled to upper half block 104 via fasteners or other means, and can permit access to the interior volume of rotating internal combustion engine 10, or more particularly the interior volume of lower half block 102 and upper half block 104 and/or could be utilized for the possible inspection/replacement of compression rings.

Moreover, in some embodiments, lower half block 102 and/or upper half block 104 can comprise one or more ports 115 for receiving a corresponding spark plug 302. Spark plugs 302 can be coupled to a corresponding electrical system for delivering an ignition spark to rotor combustion chamber 202 as described herein. Spark plugs 302 can be radially positioned to permit multi-location ignition of the fuel/air mixture. It should be understood that alternative ignition systems can be used, such as but not limited to spark, laser, flame, or compression ignition In some embodiments, lower half block 102 and/or upper half block 104 can comprise one or more exhaust ports 702 (see FIG. 1). Exhaust port 702 can comprise any physical shape, size, and/or design depending upon application needs or specifications. In some embodiments, a solenoid air valve can be used in place of or in combination with exhaust port 702 to control exhaust timing. In some embodiments, exhaust ports 702 can be designed with an anti-reversion system. In some embodiments, each of the exhaust ports 702 can be coupled with an exhaust manifold 704.

With particular reference to FIGS. 8-13, rotating internal combustion engine 10 can comprise a rotor 116 rotatably supported within lower half block 102 and upper half block 104. Although the specific configuration of rotor 116 can vary by application, power output, size, weight, and the like, it should be understood that in some embodiments, rotor 116 can comprise a central hub portion 118 and one or more radially extending disc portion 120. Central hub portion 118 can comprise opposing ends 122, 124 define a central axis A-A. In some embodiments, opposing ends 122, 124 of central hub portion 118 can having a profile shape that is complementary to supporting bearing members disposed within lower half block 102 and upper half block 104 to support rotor 116 for rotational motion about axis A-A during operation. In some embodiments, first end 122 of central hub portion 118 can comprise a first gear surface 126, for receiving a gear member, and bearing surface 128, for receiving a bearing member. The gear member can be used to output a driving force in response to production of useful energy from rotating internal combustion engine 10 via driven rotation of rotor 116. In some embodiments, second end 124 of central hub portion 118 can comprise a second bearing surface 130. In embodiments having two or more disc portions 120, a third bearing surface or shoulder surface 131 can be provided (see FIG. 11). It should also be recognized that when two or more disc portions 120 are used, each of the plurality of disc portions 120 can define identical, similar, or dissimilar sizes and/or configurations.

Figure 8:
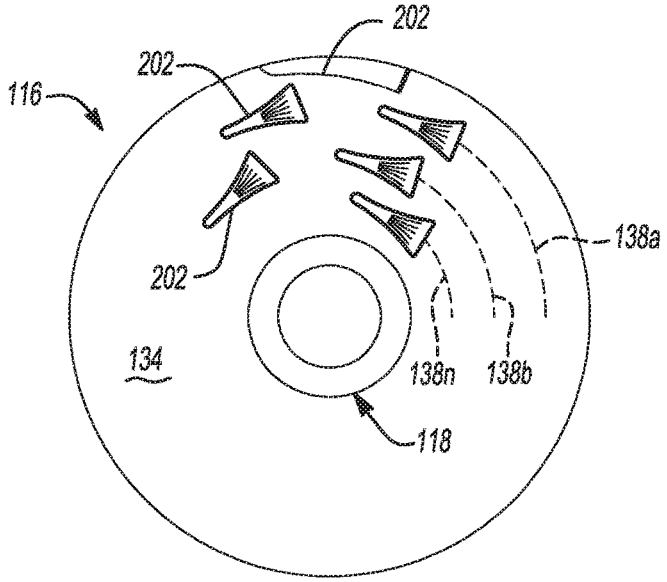
FIG. 8 is a front view illustrating a rotor having a single disc portion according to some embodiments of the present teachings.
Figure 9:
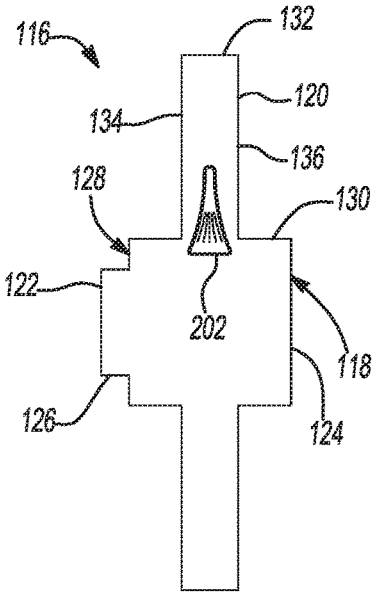
FIG. 9 is a side view illustrating the rotor having the single disc portion according to some embodiments of the present teachings.
Figure 10:
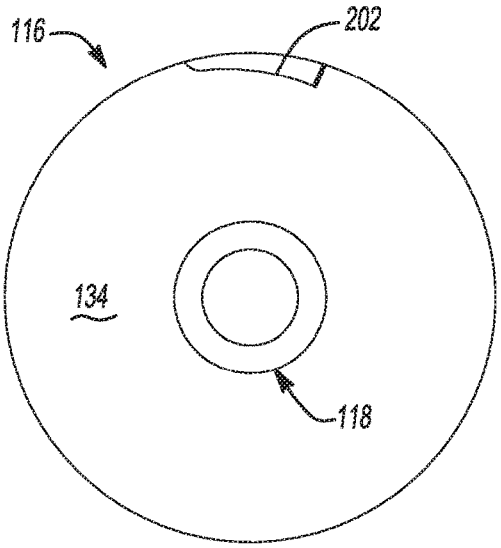
FIG. 10 is a front view illustrating a rotor having a dual disc portion according to some embodiments of the present teachings.

In some embodiments, as illustrated in FIGS. 8-9, rotor 116 is configured for a horizontally-positioned application having a single row of rotor combustion chambers 202. In some embodiments, rotor 116 can be cast or forged steel, aluminum, or other suitable material.

Figure 14A:
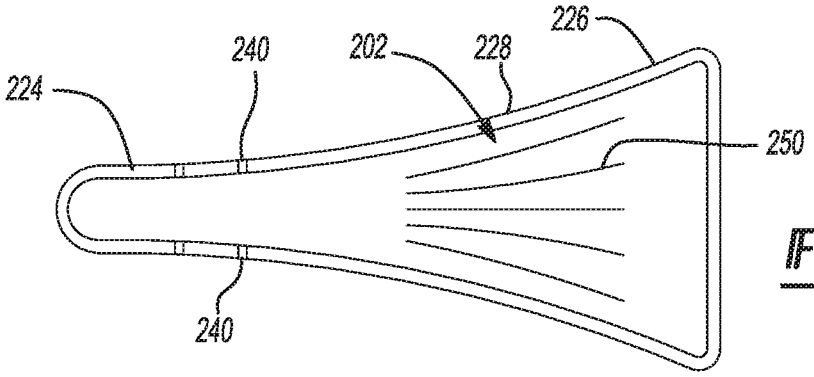
FIG. 14A is a top view illustrating a rotor combustion chamber according to the principles of the present teachings.
Figure 14B:
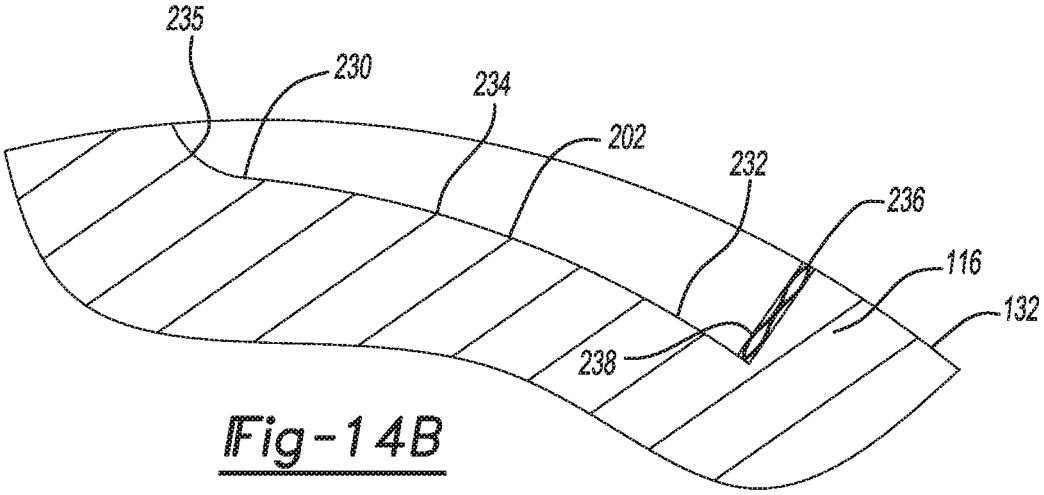
FIG. 14B is a cross-sectional view illustrating the rotor combustion chamber according to the principles of the present teachings.

With particular reference to FIGS. 14A and 14B, in some embodiments, each rotor combustion chamber 202 can define a general pyramidal shape with sloping sides and rounded edges to promote stratification and to eliminate hot spots. The pyramidal shape further promotes complete and efficient combustion. Still further, this pyramidal shape allows for advantageous pressure driving the large (leading) edge, while promoting maximum pressure rise from the ignition flame at the large (leading) edge. The pyramidal shape can be described as having a triangular shape when viewed from an exterior perspective (see FIG. 14A). The generally triangular shape can have a narrow trailing portion 224, a wide leading portion 226, and a transitionary portion 228 extending between narrow trailing portion 224 and wide leading portion 226. In some embodiments, narrow trailing portion 224 can terminate at a radiused tip 229. Likewise, in some embodiments, wide leading portion 226 can comprise a pair of radiused corners. Still further, in some embodiments, transitionary portion 228 can be generally, consistently tapered or, in some embodiments, define a transition wherein the sides thereof are convex or concave (see FIG. 14A), or define some other desirable shape.

With reference to FIG. 14B, in some embodiments, rotor combustion chamber 202 can define a slope configuration when viewed in cross-section that extends from a shallow portion 230 to a deeper portion 232 along a sloped portion 234. In some embodiments, shallow portion 230 can begin at an offset from an outer circumferential surface 132 of disc portion 120 of rotor 116 to form an upturned transitionary edge 235. However, in some embodiments, shallow portion 230 can blend into a smooth transition with outer circumferential surface 132. Likewise, deeper portion 232 can terminate at a termination edge 236 formed at outer circumferential surface 132 of rotor 116 to define a driven surface 238. Driven surface 238 is configured to provide an aerodynamic driving surface upon which chamber pressure can be used as an opposing-pressure, drive-force point. That is, chamber pressure within rotor combustion chamber 202, when aligned with drive chamber 204, can provide driving pressure to rotate rotor 116 about axis A-A when pressure exerts opposing force on drive surface 220 of drive chamber 204 and driven surface 238 of rotor combustion chamber 202. In some embodiments, termination edge 236 can define an angle with outer circumferential surface 132 in the range of 60-90 degrees, or, more preferably, in the range of 70-90 degrees. It should be understood, however, that termination edge 236 could be radiused or otherwise formed to eliminate a defined edge or reduce a corresponding burr, if desired. In some embodiments, sloped portion 234 can be linearly sloped or sloped with a radius surface as illustrated.

In some embodiments, each of the plurality of rotor combustion chambers 202 can comprise one or more drag reduction riblets 250 being casted or machined into sloped portion 234. Riblets 250 are configured to promote mixing of an air-fuel mixture, reduce the likelihood of surface wetting, and decrease the overall chamber volume of rotor combustion chamber 202.

In some embodiments, for example, wide leading portion 226 of rotor combustion chamber 202 can be about 2", narrow trailing portion 224 can be about 0.375", an axial length between narrow trailing portion 224 and wide leading portion 226 can be about 5", a depth of deeper portion 232 can be about 1", a depth of shallow portion 230 can be about "0.25", each rotor combustion chamber 202 can have a volume of 4.0-5.0 cubic inches, and should be configured to be economical in overall size and volume while in a basically pyramidal shape to promote complete and efficient combustion.

A plurality of rotor combustion chambers 202 can be disposed on and about disc portion(s) 120 or rotor 116. In some embodiments, as illustrated in FIGS. 8 and 9, rotor 116 can comprise a plurality of rotor combustion chambers 202 extending circumferentially about outer circumferential surface 132 of disc portion 120. In some embodiments, rotor combustion chambers 202 are equally spaced (e.g. equidistant) about outer circumferential surface 132. Generally, rotor combustion chambers 202 are non-expanding linear combustion chambers in that when ignition occurs and combustion pressure rises, rotation of rotor 116 holds and maintains most of the ensuing pressure during rotation because the volume of rotor combustion chamber 202 does not markedly decrease like convention piston-type engines. By way of non-limiting example, in some embodiments, rotor 116 can comprise thirty-six (36) rotor combustion chambers 202 extending about outer circumferential surface 132 of disc portion 120. Although, it should be appreciated that the number of rotor combustion chambers 202 can depend on the size and performance requirements of rotating internal combustion engine 10.

In some embodiments, as illustrated in FIGS. 8 and 9, rotor 116 can comprise a plurality of rotor combustion chambers 202 disposed on one or more side surfaces 134, 136. The plurality of rotor combustion chambers 202 disposed on one or more side surfaces 134, 136 can substantially increase the number of available rotor combustion chambers. For example, in some embodiments, rotor 116 can comprise a plurality of rotor combustion chambers 202 placed circularly on each side 134, 136 of disc portion 120 along one or more circumferential paths 138A, 138B, 138*n*. Each of the circumferential paths can be located on a centerline at various radial distances from axis A-A. For example, a plurality of rotor combustion chambers 202 are located at 40" of disc portion 120 yields an effective moment arm of 3.3333"; another twenty-six (26) rotor combustion chambers 202 evenly placed circularly on each side of disc portion 120 on a center line located at 32" of disc portion 120 yields an effective moment arm of 2.6666"; and another twenty (20) rotor combustion chambers 202 evenly placed circularly on each side of disc portion 120 on a center line located at 24" of disc portion 120 yields an effective moment arm of 2.0. A rotor 116 according to this embodiment would benefit from internally cast oil passages for rotor cooling. Moreover, in such embodiments, it would be preferred that rotor combustion chambers 202 are disposed in opposing pairs on sides 134 and 136 to minimize flex of disc portion 120 and reduce vibration. A large size rotor could be manufactured in bolt-together sections for ease of maintenance, repair, or replacement.

Figure 11:
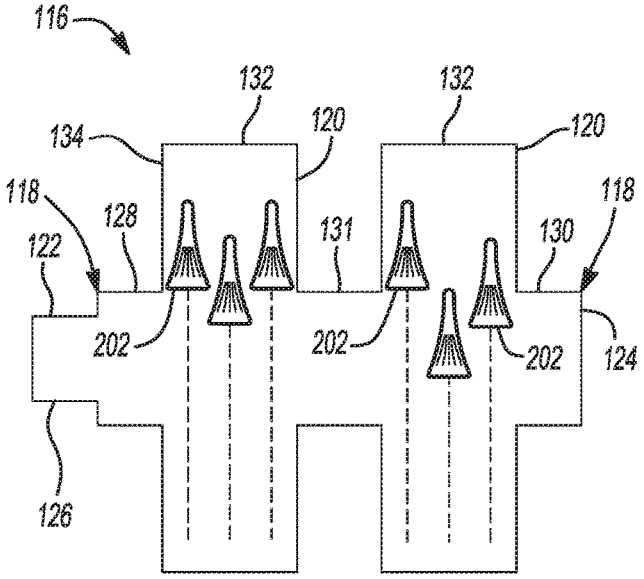
FIG. 11 is a side view illustrating the rotor having the dual disc portion according to some embodiments of the present teachings.
Figure 12:
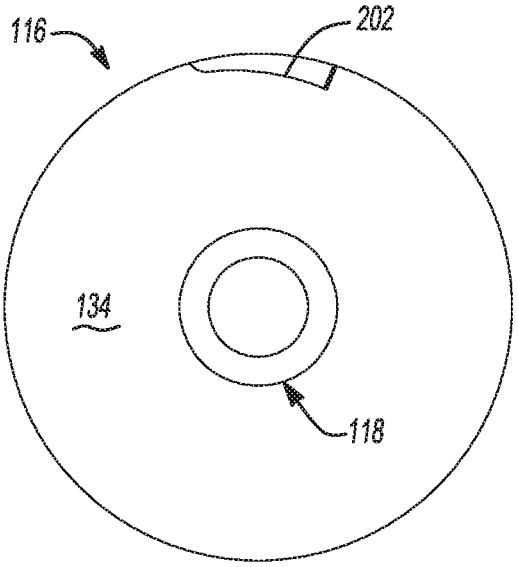
FIG. 12 is a front view illustrating a rotor having a single disc portion according to some embodiments of the present teachings.
Figure 13:
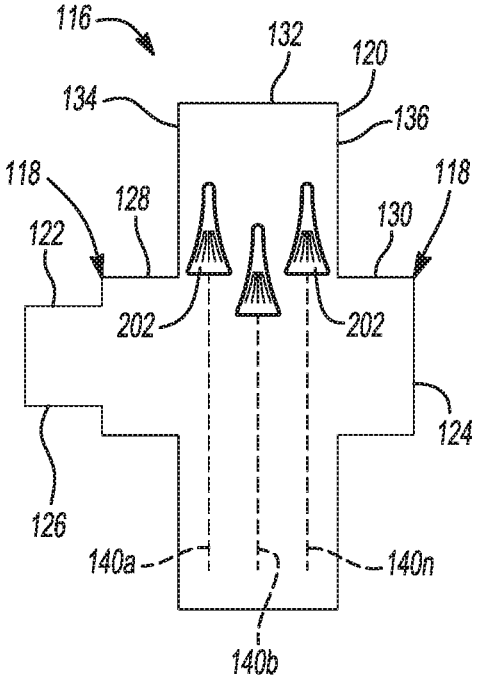
FIG. 13 is a side view illustrating the rotor having the single disc portion according to some embodiments of the present teachings.

Moreover, in some embodiments as illustrated in FIGS. 11 and 13, disc portion 120 can comprise a plurality of rotor combustion chambers 202 disposed along circumferential paths 140A, 140B, 140*n* on outer circumferential surface 132 of disc portion 120. Each of the circumferential paths 140A, 140B, 140*n* can be parallel and having an offset. In some embodiments, a distance of the offset can result in a staggered arrangement of the rotor combustion chambers 202.

Figure 15A:
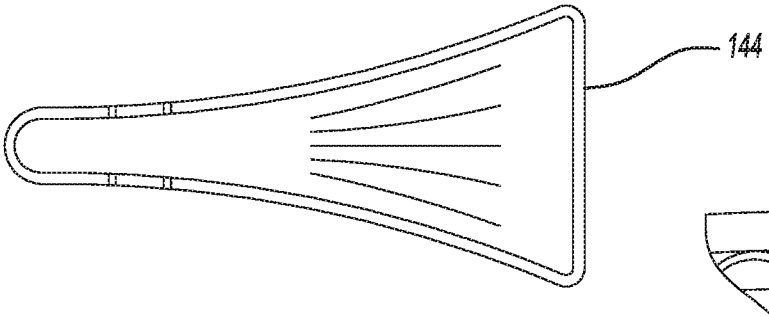
FIG. 15A is a top view illustrating a chamber compression ring according to the principles of the present teachings.
Figure 15B:
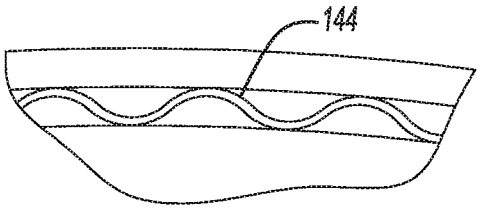
FIG. 15B is a cross-sectional view illustrating the chamber compression ring according to the principles of the present teachings.

In some embodiments, each of the plurality of rotor combustion chambers 202 can comprise one or more ring gas ports 240 emanating outward from rotor combustion chamber 202 to the ring land to provide an efficient seal for a corresponding compression ring 144. Various quantities of compression rings 144 can be incorporated as per desired requirements. In some embodiments, the seal of compression ring 144 can be assisted via a wave spring member 146, which can be mounted under a corresponding one of compression ring 144 as illustrated in FIGS. 15A and 15B. With continued reference to FIGS. 15A and 15B, in some embodiments, compression ring 144 can be made to a size, width, and shape to conform to the finished/honed/machined/cast arc of a ring travel area of lower half block 102 and upper half block 104. Compression rings 144, and any other rings or sealing members used to seal the complementary momentary joining of drive chamber 204 and rotor combustion chamber 202, can be made of ceramic, steel, cast iron, moly, or any other material for sealing/containing the pressures desired and/or developed.

Figure 16A:
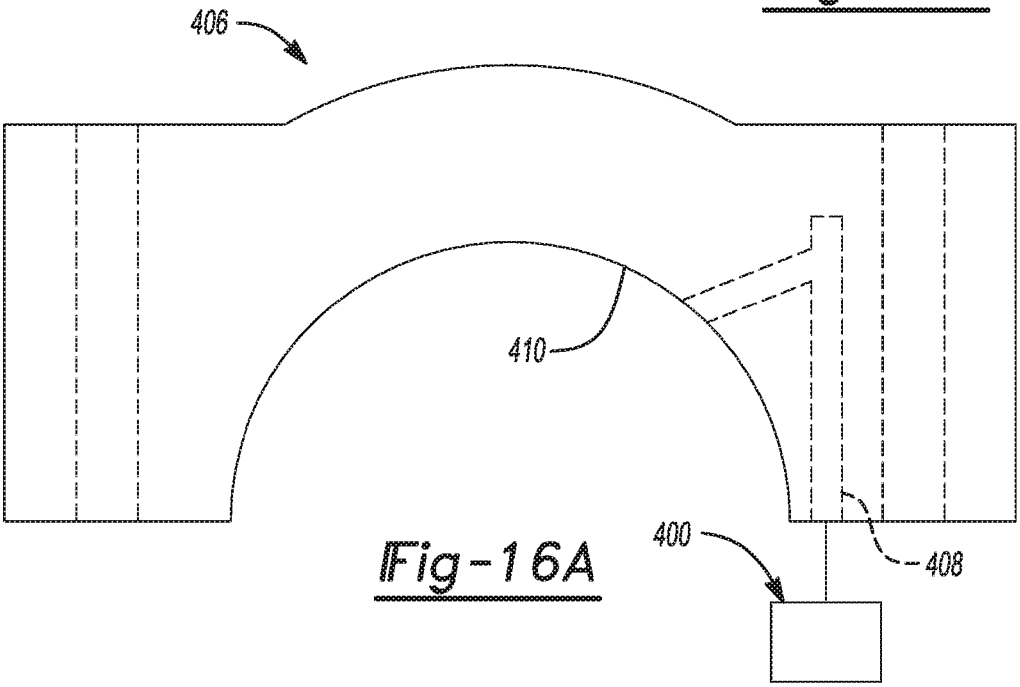
FIG. 16A is a front view illustrating a main bearing member ring according to the principles of the present teachings.
Figure 16B:
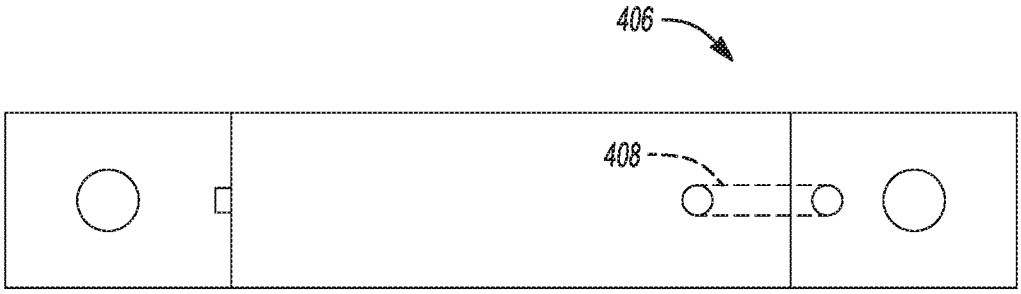
FIG. 16B is an end view illustrating the main bearing member according to the principles of the present teachings.
Figure 17A:
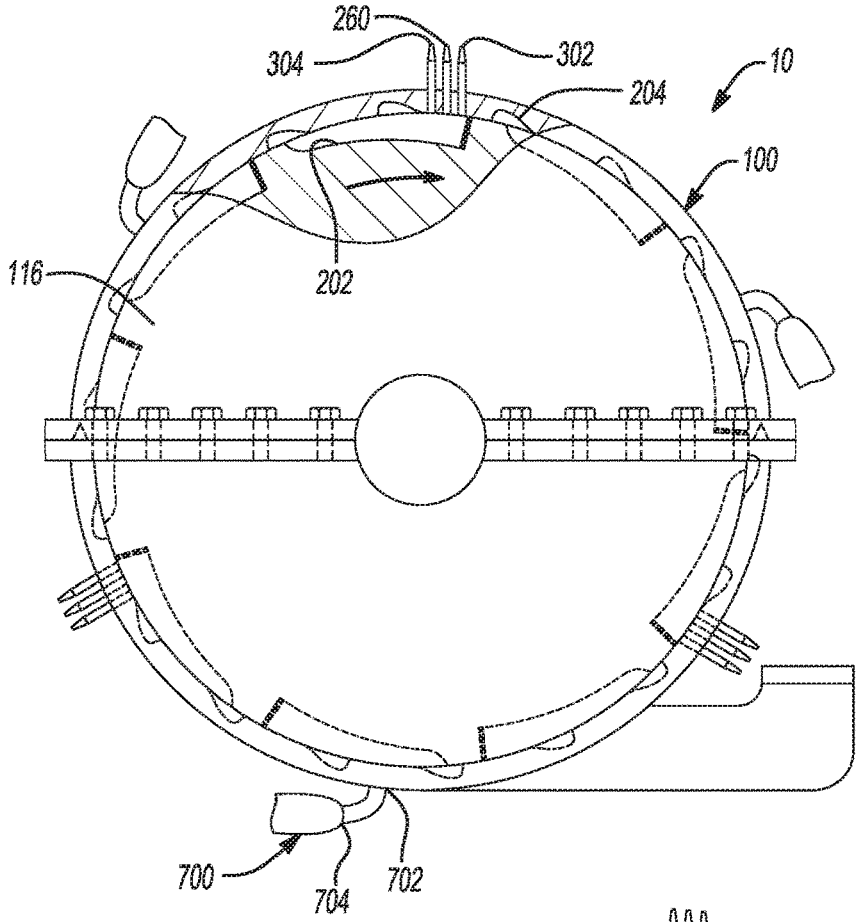
FIGS. 17A-17D is a schematic view illustrating the positional relationship of rotor combustion chamber relative to lower half block and upper half block during operation.
Figure 17B:
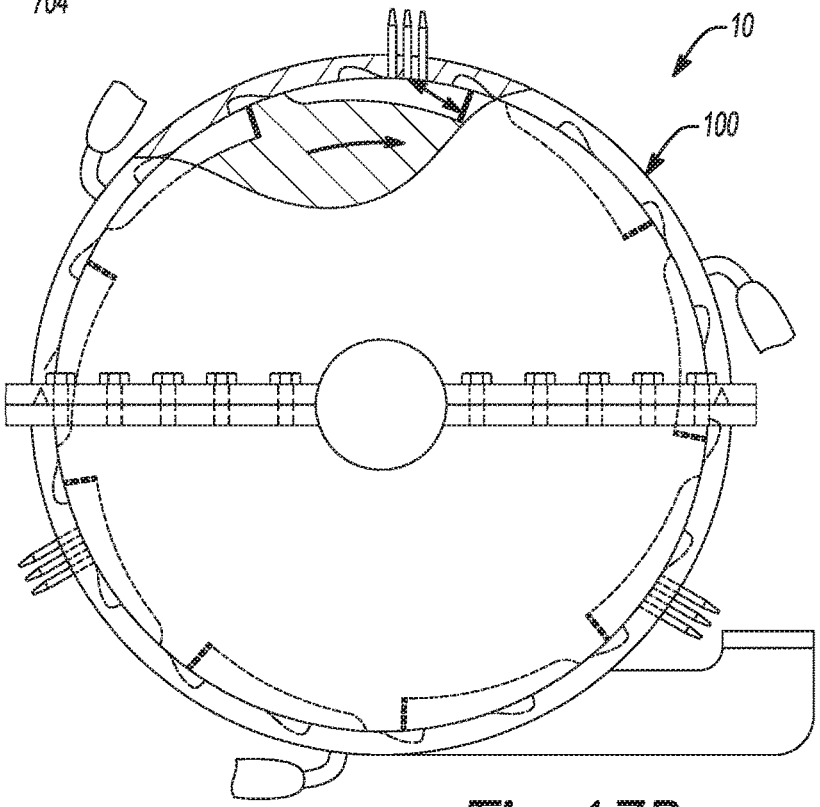
Figure 17C:
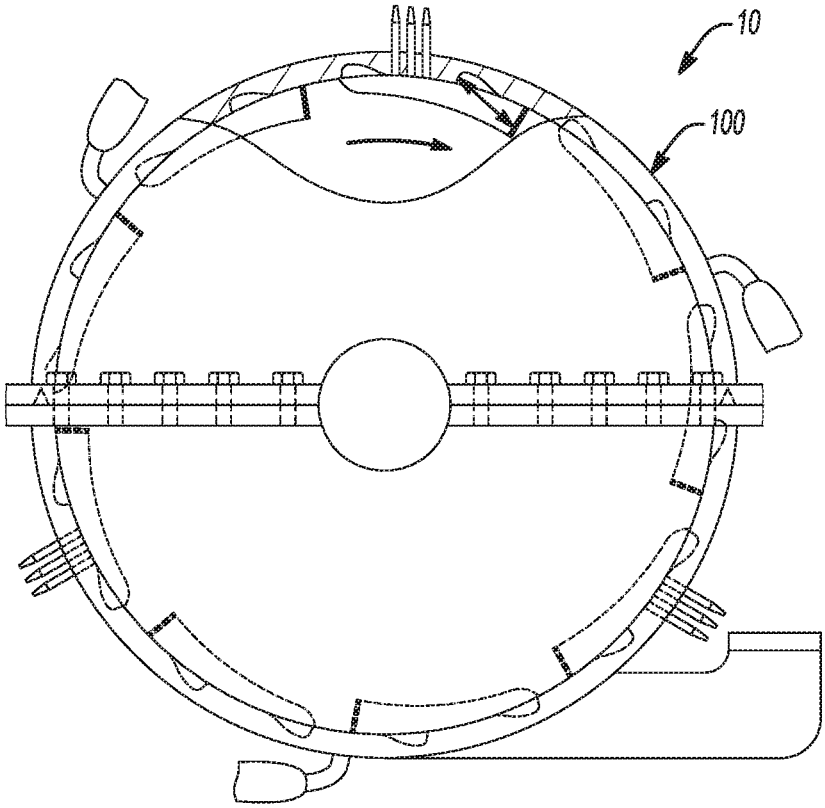
Figure 17D:
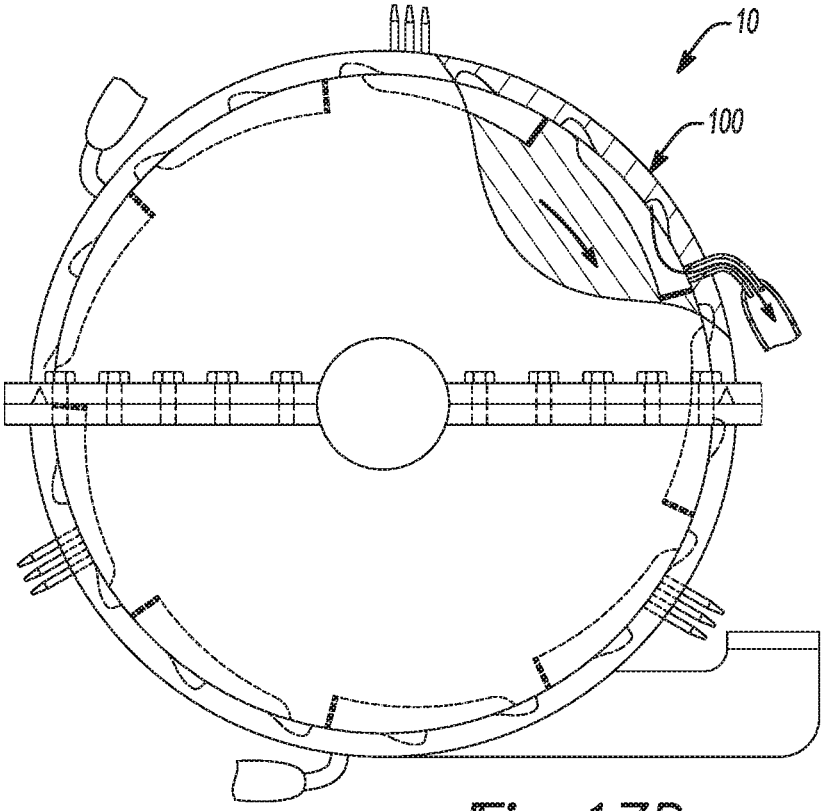

In some embodiments, rotor 116 is rotatably supported within at least one of lower half block 102 and upper half block 104 using one or more bearing members 406. As illustrated in FIGS. 16A and 16B, each main bearing member 406 can comprise a fluidic pathway 408 to permit pressurized oil or any other appropriate lubricant to enter a rotor cradle 410 formed in lower half block 102 via lubrication system 400 and flow into main bearing member 406. In some embodiments, lubricant is fed at pressure to a top side of bearing surface 128 of rotor 116 at a preferred 60° position.

In some embodiments, lubrication system 400 can comprise an oil pump assembly, an oil screen, an internal oil cooler, oil galley passage, oil filler, and associated structure for providing lubrication throughout rotating internal combustion engine 10 as necessary for operation. In some embodiments, cooling grooves 410 can be provided to efficiently splash a desired amount of oil as it is released from main bearing surface 128 onto an arc of travel that compression rings 144 sweep along lower half block 102 and upper half block 104. In some embodiments, grooves 410 provide additional surface area of rotor 116 for heat dissipation from combustion and vary or modify the reciprocating mass of rotor 116. Due to the reduced size and reduced number of moving parts in the present invention, lubrication capacities can be reduced, which will result in further associated cost reduction. To illustrate, nearly 100 million automobiles and light and medium trucks are manufactured yearly. Reduction of merely one (1) quart of oil capacity would result in a reduction which would amount to 200-300 million quarts in just a single year, or 75 million gallons of oil. Due to the minimal oiling requirements of only main bearings in such embodiment, with the use of an oil filter having a capacity of approximately 0.5 qt., and an internal oil cooler designed into the oil sump, the total engine oil capacity of such an engine could be near 2.5 qts resulting in huge global savings versus conventional engines currently in production.

With reference to FIGS. 17A-D, the operation of rotating internal combustion engine 10 will be discussed in detail. Rotor 116 is disposed within lower half block 102 and upper half block 104 for rotation therein. To this end, rotor 116 includes side surfaces 134, 136 and outer circumferential surface 132 that are closely apposed to corresponding inner surfaces of lower half block 102 and upper half block 104 such that rotor combustion chambers 202 form a fluid seal with the inner surfaces of lower half block 102 and upper half block 104. In some embodiments, compression ring 144 is disposed there between to promote such sealing engagement. In some embodiments, air inlet source 260 and fuel injection 304 are positioned within lower half block 102 and/or upper half block 104 to inject air and fuel, respectively, into rotor combustion chamber 202 as rotor combustion chamber 202 passes thereby. In some embodiments, air inlet source 260 is coupled to an air source 262, which can optionally comprise a turbocharger, supercharger, ram air inlet, ambient air inlet, or the like. Air inlet source 260 and fuel injection 304 can be positioned near each other and generally adjacent each of the spark plugs 302. As rotor 116 rotates about axis A-A, each of the plurality of rotor combustion chambers 202 comes adjacent air inlet source 260, fuel injection 304, and spark plug 302 whereby fuel and air (or other oxidants) are combined in rotor combustion chamber 202 and subsequently ignited via spark plug 302 at a predetermined time.

In some embodiments, the fuel and air are injected into rotor combustion chamber 202 as driven surface 238 passes air inlet source 260 and fuel injection 304 and results in a combined mixture suitable for ignition. As spark plug 302 is actuated, a flame front is created within rotor combustion chamber 202, exerting increasing gas pressure within rotor combustion chamber 202. When ignition occurs, pressure rises nearly 4-5 times, imparting a much higher force upon rotor 116. As the flame front continues to burn within rotor combustion chamber 202, the flame front travels from the wide leading portion 226 toward the narrow trailing portion 224 and experiences a transition from a rich mixture to a lean mixture that promote complete and efficient combustion of the air and fuel mixture. That is, the leading edge can have a more rich mixture to promote easy ignition with the trailing end of the pyramidal shape can be leaner to promote a more complete burn process.

As the pressure within rotor combustion chamber 202 increases due to the combustion of the air and fuel mixture, rotor 116 continues to rotate about axis A-A. At a desired positioned, one or more drive chambers 204 apposes rotor combustion chamber 202. In this way, drive surface 220 of drive chamber 204 is in opposing position relative to surface 238 of rotor combustion chamber 202 such that pressure within now combined rotor combustion chamber 202 and drive chamber 204 exerts offset pressure forces there between. These offset pressure forces exert a driving force against rotor 116 that cause rotor 116 to rotate about axis A-A and consequently drive a gear system coupled at gear surface 126. Because of the shape and contour of rotor combustion chamber 202 and drive chamber 204, these pressure forces within the chamber—equal in all directions—can only exert a movement on the generally flat surfaces (is drive surface 220 and surface 238), thereby forcing rotation of rotor 116. The pyramidal shape puts the same driving pressure on the leading edge, but reduces the overall volume by nearly ⅔, which results in fuel savings. In some embodiments, a plurality of drive chambers 204 can be in communication with rotor combustion chamber 202 simultaneously.

As rotor 116 moves approximately the length of combustion chamber 202, a secondary drive chamber 204 is uncovered, and the original drive chamber is passed by. The pressure now subsides by a small percentage of the ratio of the volume of drive chamber 204 to the volume of combustion chamber 202. Additionally, a small amount of pressure is lost to minor heat loss to engine block 100 and rotor 116. However, this remaining pressure is still producing torque and is still rotating rotor 116, thus extracting more work. Additional tertiary drive chambers could be utilized depending upon designed size parameters and requirements.

As the offset pressure force is converted into rotational energy of rotor 116, rotor combustion chamber 202 continues to rotate relative to lower half block 102 and upper half block 104 and is aligned with exhaust port 702, whereby the consumed products of combustion are exhausted and the process is able to repeat at the next stage. In some embodiments, this process can be completed several times per revolution of rotor 116, such as but not limited to three (3) complete combustion cycles.

A small amount of residual spent gasses in drive chamber 204 may escape into the following rotor combustion chamber 202 and gasses from rotor combustion chamber 202 and drive chamber 204 may escape into engine block 100 and can be evacuated by a positive crankcase ventilation system and/or directed into an air injector system 260. Purging of the exhaust gas is assisted by the injection of oxidants, but only if the system computer and the demands of the engine require a subsequent energization of the same combustion chamber.

After running, rotating internal combustion engine 10 can idle with as few as one or as many rotor combustion chambers 202 activated and in any order to reduce fuel, heat dissipation, emissions, and other associated factors. However, under full load, each row of rotor combustion chambers could each have three (3) firing impulses per revolution, such that with all 6 rows and 9 rotor combustion chambers per row, as many as 162 firing impulses are available per revolution. With the expected power output of rotating internal combustion engine 10 at very low rotating speeds (i.e. <3000) the necessity to reach high rotational speeds should not be required, further reducing frictional waste, but requiring appropriate changes to transmission and final gear ranges.

According to the present teachings, rotating internal combustion engine 10 can produce more torque than traditional engines. The average torque developed in a 350 cubic inch small block Chevy engine is measured at each degree in the piston's power stroke. At higher speeds, the torque increases as pressure develops and peaks around 90 degrees of crank rotation, or about when the piston has travelled halfway down the cylinder. After that, pressure quickly diminishes as the cylinder volume increases and the exhaust valve begins to open. At low speeds, the airflow into the cylinder is hampered by both a partly closed throttle and low velocity air entering the cylinder. Since torque is measured by the force pushing on a lever, the crank stroke (which is 3.48 inches) becomes a lever only 1.74" (a torque moment of 0.145 ft.). Thus, at lower speeds and at less than 90 degrees, conventional piston and rod configurations push on the rod journal at a weaker angle (measured by the Sine of the crank arm angle) further reducing the produced torque. On the other hand, rotating internal combustion engine 10 cylinder filling (that is, filling of each rotor combustion chamber 202) is optimized at all speeds, and the force of combustion is exerted always at or near 90 degrees, and at a much longer radius. In addition, when extra power is needed, each chamber can produce power multiple times in a single rotor revolution. Because so much torque is produced at lower engine speeds, high rpm's are not needed and could be computer limited.

It should be understood that rotating internal combustion engine 10 is capable of a wide variety of sizes and capabilities. A conceptual design with an 18" diameter rotor 116 having six (6) rows, each containing nine (9) rotor combustion chambers 202, would have outside dimensions equivalent to a standard big block engine, such as a Chevy 454 or Ford 460. When shut off, there are always a number of rotor combustion chambers 202 in a position to allow for chamber pressurization, fuel atomization, and spark to allow for instantaneous startup without an electric starter motor. However, it should be appreciated that an electric starter motor can be used, if desired; in doing so, reduced starter motor size and capacity and associated battery size and capacity can be reduced. When starting, any number of rotor combustion chambers 202 can ignite, and if there's any problem, the other combustion chambers are immediately in position to take over, such as with a fuel problem. Such operation without a starter motor can be achieved using a positive, real-time crankshaft positioning system, using, for example, sensors, readers, RFID tags, QR symbols, or other forms of instantaneous relay of the exact position of rotor 116 to an engine operating control system to enable command output of discrete ignition of spark plugs associated with select rotor combustion chambers 202. In some embodiments, this would require one or more pressurized oxidant storage tanks to initialize engine cold starting sequence. With the proper flow check and solenoid valves, residual stored oxidant would remain available indefinitely.

The principles of the present teachings are applicable to more than the automobile industry. Although the automobile and light truck industry is one target for usage, these principles are applicable when reduced in size to traditional small engine markets, such as lawn mowers, yard & farm tractors, ATVs, RVs, recreational boating, motorcycles, industrial power plants, and the like. Likewise, these principles are applicable when enlarged to produce huge amounts of torque to use in the heavy truck, farm & road construction, industrial, mining, aircraft, rail, and shipping industries. In addition, conversion to diesel, propane, and many other fuels can be easy to accomplish.

In some embodiments, there are ancillary systems that would benefit rotating internal combustion engine 10. First, an appropriately sized air compressor geared to spin at the proper rpm would be desirable to provide pressured air at air inlet source. Furthermore, an oil pump (possibly electric) would ideally provide approximately 3-4 GPM at a very low speed of about 50-3000 rpm. Additionally, a crankshaft position sensor (CPS) capable of quickly determining the position of rotor 116 would enable instant starting without an attached electric starter motor. As technology improves, this CPS could work fast enough to completely control the multiple firing impulses of this engine.

The following facets of rotating internal combustion engine 10 contribute to better emissions and fuel economy. A standard engine operates much of the time with much reduced cylinder pressure due to throttle position pumping losses. However, rotating internal combustion engine 10 uses the most advantageous cylinder pressure for the given situation, usually around 150+ psi., even at idle speed. Clean, efficient burning can only happen at this higher pressure. Because only that number of rotor combustion chambers 202 required to be firing are used at any moment, there is very low waste of fuel, and thus lower emission byproducts. In addition, the pyramidal shape of rotor combustion chamber 202 offers a richer mixture at the leading edge near the initial ignition event. As the flame front travels toward the small end of the chamber, it quickly builds even higher pressure and the mixture is now in a leaner condition permitting a much cleaner overall burn.

Durability of rotating internal combustion engine 10 is also enhanced compared to conventional designs. With far fewer functioning parts, and the accompanying pressure contact points such as a conventional valve train would have, longevity is easy to realize. Generally, having less bearing surfaces and reciprocating parts, plus having ignition pressures applied at 90 degrees from the shaft radius instead of trying to drive a connecting rod thru a crankshaft, as in a conventional engine, is a huge reduction in stress and bearing wear. Using proper gearing to take advantage of the torque produced and limiting unnecessary engine speeds would keep ring wear to a minimum.

It should be appreciated that rotating internal combustion engine 10 can be manufactured with current manufacturing and machining technology, including but not limited to casting and tool bit, honing stone, laser, or EDM practices.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A rotating internal combustion engine comprising:

an engine block having an interior combustion surface;

a plurality of drive chambers formed in the interior combustion surface, each of the plurality of drive chambers having a drive surface and a sloped transitionary portion;

a rotor having a hub portion and a radially extending disc portion, the hub portion having a bearing surface and a gear engagement surface, the rotor being rotatably supported within the engine block to rotate relative thereof;

a plurality of rotor combustion chambers formed in the rotor, each of the plurality of rotor combustion chambers being in sealing engagement with the interior combustion surface of the engine block, each of the plurality of rotor combustion chambers having a driven surface and a sloped transitionary portion;

a fuel system having a fuel injector configured to introduce a fuel into each of the plurality of rotor combustion chambers upon rotational movement of each of the plurality of rotor combustion chambers relative to the fuel injector;

an air induction system having an air inlet configured to introduce air into each of the plurality of rotor combustion chambers upon rotational movement of each of the plurality of rotor combustion chambers relative to the air inlet; and an ignition system having an ignition source configured to ignite the fuel and air in at least one of the plurality of rotor combustion chambers resulting in combustion thereof and increasing combustion pressure within the at least one of the plurality of rotor combustion chambers, wherein the combustion pressure is exerted upon the drive surface of at least one of the plurality of drive chambers of the engine block and the driven surface of the at least one of the plurality of rotor combustion chambers of the rotor resulting in driven rotation of the rotor, wherein the disc portion of the rotor comprises side surfaces terminating at a circumferential surface and the plurality of rotor combustion chambers are formed in the circumferential surface of the rotor, the plurality of rotor combustion chambers being offset along a plurality of circumferential paths.

2. The rotating internal combustion engine according to claim 1 wherein the plurality of rotor combustion chambers disposed offset along the plurality of circumferential paths are staggered radially such that at least one of the plurality of rotor combustion chambers is aligned for combustion.

3. The rotating internal combustion engine according to claim 1 wherein each of the plurality of rotor combustion chambers comprises a pyramidal-shaped volume having the driven surface and the sloped transitionary portion, the pyramidal-shaped volume being tapered from a leading portion to a trailing portion.

4. The rotating internal combustion engine according to claim 1 wherein the driven surface of each of the plurality of rotor combustion chambers is substantially flat and substantially orthogonal to a tangent of the rotor.

5. The rotating internal combustion engine according to claim 1 wherein the driven surface of each of the plurality of rotor combustion chambers is substantially flat and between 70-90 degrees relative to a tangent of the rotor.

6. The rotating internal combustion engine according to claim 1 wherein the drive surface of each of the plurality of drive chambers is substantially orthogonal to the interior combustion surface.

7. The rotating internal combustion engine according to claim 1 wherein the drive surface of each of the plurality of drive chambers is between 70-90 degrees relative to the interior combustion surface.

8. The rotating internal combustion engine according to claim 1 wherein each of the plurality of drive chambers and each of the plurality of combustion chambers are sized such that at least one of the plurality of combustion chambers is in fluid communication with at least two of the plurality of drive chambers during combustion.

9. The rotating internal combustion engine according to claim 1 wherein each of the plurality of rotor combustion chambers comprises a pyramidal-shaped volume having the driven surface and the sloped transitionary portion, the sloped transitionary portion having a convex side.

10. The rotating internal combustion engine according to claim 1 wherein each of the plurality of rotor combustion chambers comprises a pyramidal-shaped volume having the driven surface and the sloped transitionary portion, the sloped transitionary portion having a concave side.

11. The rotating internal combustion engine according to claim 1 wherein each of the plurality of rotor combustion chambers comprises a riblet disposed within the sloped transitionary portion.

12. The rotating internal combustion engine according to claim 1 wherein each of the plurality of rotor combustion chambers comprises a ring gas port.

13. The rotating internal combustion engine according to claim 1, further comprising a compression ring configured to seal one of the plurality of drive chambers and a corresponding one of the plurality of rotor combustion chamber.

14. A rotating internal combustion engine comprising:

an engine block having an interior combustion surface;

a plurality of drive chambers formed in the interior combustion surface, each of the plurality of drive chambers having a drive surface and a sloped transitionary portion;

a rotor having a hub portion and a radially extending disc portion, the hub portion having a bearing surface and a gear engagement surface, the rotor being rotatably supported within the engine block to rotate relative thereof;

a plurality of rotor combustion chambers formed in the rotor, each of the plurality of rotor combustion chambers being in sealing engagement with the interior combustion surface of the engine block, each of the plurality of rotor combustion chambers having a driven surface and a sloped transitionary portion;

a fuel system having a fuel injector configured to introduce a fuel into each of the plurality of rotor combustion chambers upon rotational movement of each of the plurality of rotor combustion chambers relative to the fuel injector;

an air induction system having an air inlet configured to introduce air into each of the plurality of rotor combustion chambers upon rotational movement of each of the plurality of rotor combustion chambers relative to the air inlet; and an ignition system having an ignition source configured to ignite the fuel and air in at least one of the plurality of rotor combustion chambers resulting in combustion thereof and increasing combustion pressure within the at least one of the plurality of rotor combustion chambers, wherein the combustion pressure is exerted upon the drive surface of at least one of the plurality of drive chambers of the engine block and the driven surface of the at least one of the plurality of rotor combustion chambers of the rotor resulting in driven rotation of the rotor, wherein the disc portion of the rotor comprises side surfaces terminating at a circumferential surface and at least one of the plurality of rotor combustion chambers is formed in at least one of the side surfaces of the rotor, the at least one of the plurality of rotor combustion chambers being in sealing engagement with the interior combustion surface of the engine block.

15. The rotating internal combustion engine according to claim 14 wherein the plurality of rotor combustion chambers being aligned along a radial path.

16. The rotating internal combustion engine according to claim 14 wherein the plurality of rotor combustion chambers are further formed in the circumferential surface of the rotor.

17. The rotating internal combustion engine according to claim 14 wherein each of the plurality of rotor combustion chambers comprises a pyramidal-shaped volume having the driven surface and the sloped transitionary portion, the pyramidal-shaped volume being tapered from a leading portion to a trailing portion.

18. The rotating internal combustion engine according to claim 14 wherein the drive surface of each of the plurality of drive chambers is substantially orthogonal to the interior combustion surface.

19. The rotating internal combustion engine according to claim 14 wherein the drive surface of each of the plurality of drive chambers is between 70-90 degrees relative to the interior combustion surface.

20. The rotating internal combustion engine according to claim 14 wherein each of the plurality of drive chambers and each of the plurality of combustion chambers are sized such that at least one of the plurality of combustion chambers is in fluid communication with at least two of the plurality of drive chambers during combustion.

21. The rotating internal combustion engine according to claim 14 wherein each of the plurality of rotor combustion chambers comprises a pyramidal-shaped volume having the driven surface and the sloped transitionary portion, the sloped transitionary portion having a convex side.

22. The rotating internal combustion engine according to claim 14 wherein each of the plurality of rotor combustion chambers comprises a pyramidal-shaped volume having the driven surface and the sloped transitionary portion, the sloped transitionary portion having a concave side.

23. The rotating internal combustion engine according to claim 14 wherein each of the plurality of rotor combustion chambers comprises a riblet disposed within the sloped transitionary portion.

24. The rotating internal combustion engine according to claim 14 wherein each of the plurality of rotor combustion chambers comprises a ring gas port.

25. The rotating internal combustion engine according to claim 14, further comprising a compression ring configured to seal one of the plurality of drive chambers and a corresponding one of the plurality of rotor combustion chamber.

26. The rotating internal combustion engine according to claim 14 wherein the plurality of rotor combustion chambers being offset along a plurality of radial paths.

27. The rotating internal combustion engine according to claim 26 wherein the plurality of rotor combustion chambers disposed offset along the plurality of radial paths are staggered radially such that at least one of the plurality of rotor combustion chambers is aligned for combustion.

28. The rotating internal combustion engine according to claim 14 wherein the rotor comprises a plurality of radially extending disc portions.

29. The rotating internal combustion engine according to claim 28 wherein the plurality of rotor combustion chambers are aligned along a circumferential path of at least one of the plurality of radially extending disc portions.

30. The rotating internal combustion engine according to claim 28 wherein the plurality of rotor combustion chambers are offset along a plurality of circumferential paths of at least one of the plurality of radially extending disc portions.

31. A rotating internal combustion engine comprising:

an engine block having an interior combustion surface;

a plurality of drive chambers formed in the interior combustion surface, each of the plurality of drive chambers having a drive surface and a sloped transitionary portion;

a rotor having a hub portion and a radially extending disc portion, the hub portion having a bearing surface and a gear engagement surface, the rotor being rotatably supported within the engine block to rotate relative thereof;

a plurality of rotor combustion chambers formed in the rotor, each of the plurality of rotor combustion chambers being in sealing engagement with the interior combustion surface of the engine block, each of the plurality of rotor combustion chambers having a driven surface and a sloped transitionary portion;

a fuel system having a fuel injector configured to introduce a fuel into each of the plurality of rotor combustion chambers upon rotational movement of each of the plurality of rotor combustion chambers relative to the fuel injector;

an air induction system having an air inlet configured to introduce air into each of the plurality of rotor combustion chambers upon rotational movement of each of the plurality of rotor combustion chambers relative to the air inlet; and an ignition system having an ignition source configured to ignite the fuel and air in at least one of the plurality of rotor combustion chambers resulting in combustion thereof and increasing combustion pressure within the at least one of the plurality of rotor combustion chambers, wherein the combustion pressure is exerted upon the drive surface of at least one of the plurality of drive chambers of the engine block and the driven surface of the at least one of the plurality of rotor combustion chambers of the rotor resulting in driven rotation of the rotor, wherein the interior combustion surface of the engine block is cylindrical and the plurality of drive chambers are disposed at a regular interval about the cylindrical interior surface.

32. The rotating internal combustion engine according to claim 31 wherein the regular interval is configured such that at least one of the plurality of rotor combustion chambers is aligned for combustion.

33. The rotating internal combustion engine according to claim 31 wherein the regular interval is every 20 degrees about the cylindrical interior surface.

34. The rotating internal combustion engine according to claim 31 wherein each of the plurality of rotor combustion chambers comprises a pyramidal-shaped volume having the driven surface and the sloped transitionary portion, the pyramidal-shaped volume being tapered from a leading portion to a trailing portion.

35. The rotating internal combustion engine according to claim 31 wherein at least one of the plurality of drive chambers is aligned along a rotational path with another one of the plurality of drive chambers.

36. The rotating internal combustion engine according to claim 31 wherein at least one of the plurality of drive chambers is offset aligned along a rotational path with another one of the plurality of drive chambers.

37. The rotating internal combustion engine according to claim 31 wherein each of the plurality of rotor combustion chambers comprises a pyramidal-shaped volume having the driven surface and the sloped transitionary portion, the sloped transitionary portion having a convex side.

38. The rotating internal combustion engine according to claim 31 wherein each of the plurality of rotor combustion chambers comprises a pyramidal-shaped volume having the driven surface and the sloped transitionary portion, the sloped transitionary portion having a concave side.

39. The rotating internal combustion engine according to claim 31 wherein each of the plurality of rotor combustion chambers comprises a riblet disposed within the sloped transitionary portion.

40. The rotating internal combustion engine according to claim 31 wherein each of the plurality of rotor combustion chambers comprises a ring gas port.

41. The rotating internal combustion engine according to claim 31, further comprising a compression ring configured to seal one of the plurality of drive chambers and a corresponding one of the plurality of rotor combustion chamber.

42. A rotating internal combustion engine comprising:

an engine block having an interior combustion surface;

a plurality of drive chambers formed in the interior combustion surface, each of the plurality of drive chambers having a drive surface and a sloped transitionary portion;

a rotor having a hub portion and a radially extending disc portion, the hub portion having a bearing surface and a gear engagement surface, the rotor being rotatably supported within the engine block to rotate relative thereof;

a plurality of rotor combustion chambers formed in the rotor, each of the plurality of rotor combustion chambers being in sealing engagement with the interior combustion surface of the engine block, each of the plurality of rotor combustion chambers having a driven surface and a sloped transitionary portion;

a fuel system having a fuel injector configured to introduce a fuel into each of the plurality of rotor combustion chambers upon rotational movement of each of the plurality of rotor combustion chambers relative to the fuel injector;

an air induction system having an air inlet configured to introduce air into each of the plurality of rotor combustion chambers upon rotational movement of each of the plurality of rotor combustion chambers relative to the air inlet; and an ignition system having an ignition source configured to ignite the fuel and air in at least one of the plurality of rotor combustion chambers resulting in combustion thereof and increasing combustion pressure within the at least one of the plurality of rotor combustion chambers, wherein the combustion pressure is exerted upon the drive surface of at least one of the plurality of drive chambers of the engine block and the driven surface of the at least one of the plurality of rotor combustion chambers of the rotor resulting in driven rotation of the rotor, wherein each of the plurality of drive chambers and each of the plurality of combustion chambers are sized such that at least one of the plurality of combustion chambers is continuously in fluid communication with at least one of the plurality of drive chambers during a complete rotation of the rotor.

43. The rotating internal combustion engine according to claim 42 wherein each of the plurality of rotor combustion chambers comprises a pyramidal-shaped volume having the driven surface and the sloped transitionary portion, the pyramidal-shaped volume being tapered from a leading portion to a trailing portion.

44. The rotating internal combustion engine according to claim 42 wherein the plurality of rotor combustion chambers being aligned along a path.

45. The rotating internal combustion engine according to claim 42 wherein the plurality of rotor combustion chambers being offset along a plurality of paths.

46. The rotating internal combustion engine according to claim 42 wherein the plurality of rotor combustion chambers are formed in the circumferential surface of the rotor.

47. The rotating internal combustion engine according to claim 42 wherein the plurality of rotor combustion chambers are formed in at least one of the side surfaces of the rotor.

48. The rotating internal combustion engine according to claim 42 wherein each of the plurality of rotor combustion chambers comprises a pyramidal-shaped volume having the driven surface and the sloped transitionary portion, the pyramidal-shaped volume being tapered from a leading portion to a trailing portion.

49. The rotating internal combustion engine according to claim 42 wherein the drive surface of each of the plurality of drive chambers is substantially orthogonal to the interior combustion surface.

50. The rotating internal combustion engine according to claim 42 wherein the drive surface of each of the plurality of drive chambers is between 70-90 degrees relative to the interior combustion surface.

51. The rotating internal combustion engine according to claim 42 wherein each of the plurality of drive chambers and each of the plurality of combustion chambers are sized such that at least one of the plurality of combustion chambers is in fluid communication with at least two of the plurality of drive chambers during combustion.

52. The rotating internal combustion engine according to claim 42 wherein each of the plurality of rotor combustion chambers comprises a pyramidal-shaped volume having the driven surface and the sloped transitionary portion, the sloped transitionary portion having a convex side.

53. The rotating internal combustion engine according to claim 42 wherein each of the plurality of rotor combustion chambers comprises a pyramidal-shaped volume having the driven surface and the sloped transitionary portion, the sloped transitionary portion having a concave side.

54. The rotating internal combustion engine according to claim 42 wherein each of the plurality of rotor combustion chambers comprises a riblet disposed within the sloped transitionary portion.

55. The rotating internal combustion engine according to claim 42 wherein each of the plurality of rotor combustion chambers comprises a ring gas port.

56. The rotating internal combustion engine according to claim 42, further comprising a compression ring configured to seal one of the plurality of drive chambers and a corresponding one of the plurality of rotor combustion chamber.

57. The rotating internal combustion engine according to claim 42 wherein the rotor comprises a plurality of radially extending disc portions.

58. The rotating internal combustion engine according to claim 57 wherein the plurality of rotor combustion chambers are aligned along a circumferential path of at least one of the plurality of radially extending disc portions.

59. The rotating internal combustion engine according to claim 57 wherein the plurality of rotor combustion chambers are offset along a plurality of circumferential paths of at least one of the plurality of radially extending disc portions.

* * * * *